United States Patent [19]

Okuya et al.

[11] Patent Number: 4,504,818

[45] Date of Patent: Mar. 12, 1985

[54] SLIDE RHEOSTAT

[75] Inventors: Tsutae Okuya, Miyagi; Yoshiyuki Ito, Wakuya, both of Japan

[73] Assignee: Alps Electric Co., Ltd., Tokyo, Japan

[21] Appl. No.: 527,661

[22] Filed: Aug. 30, 1983

[30] Foreign Application Priority Data

Aug. 30, 1982 [JP] Japan ..... 57-129638[U]

[51] Int. Cl.[3] ..... H01C 10/38

[52] U.S. Cl. ..... 338/119; 338/196; 338/165

[58] Field of Search ..... 338/119, 160, 161, 196, 338/176, 165

[56] References Cited

U.S. PATENT DOCUMENTS 3,735,047 5/1973 Kawada et al. ..... 338/128 X
3,909,770 9/1975 Oka et al. ..... 338/119
4,005,381 1/1977 Klug ..... 338/128 X
4,426,634 1/1984 Okuya et al. ..... 338/176 X

*Primary Examiner*—Roy N. Envall, Jr.
*Assistant Examiner*—C. N. Sears
*Attorney, Agent, or Firm*—Guy W. Shoup; Gerard F. Dunne

[57] ABSTRACT

In a slide rheostat with first and second light sources wherein at least one set of resistor and collector is printed on an insulating base plate so as to establish a variable resistance, and wherein the first and second light sources are disposed so as to display the resistance in either of their emission colors, the light sources being connected to a common lead and at least one power supply lead so as to be energized; the improvement comprising the fact that the power supply lead is formed with a portion adopted to accommodate the sliders energizing both of the light sources so as to emit light in the composite color of their emission colors.

9 Claims, 7 Drawing Figures

SLIDE RHEOSTAT

BACKGROUND OF THE INVENTION

The present invention relates to a slide rheostat with light source means which is well-suited for application to a graphic equalizer or an audio equipment performing balance adjustment or the like. More particularly, it relates to a slide rheostat in which light sources of different emission colors are mounted on a lever extending outwardly from a case, and they emit light separately or simultaneously in any selected region within an adjustable resistance range, whereby the resistance value of the slide rheostat can be recognized.

By way of example, there has been used a slide rheostat with light source means wherein two light sources of different emission colors (e.g., red and yellow) are mounted on a lever, and they are caused to emit red light and yellow light in any selected region within an adjustable resistance range so as to indicate a tone range, a tone quality or the like.

This prior-art slide rheostat with light source means employs light emitting diodes as light sources. The terminals of the light sources are individually connected to light source sliders, and these light source sliders can be slid in contact with power supply leads and a common lead printed on an insulating base plate, thereby causing the light sources to emit light.

In the prior-art slide rheostat with such light source means, however, when the hues of the light sources change over, the light sources are temporarily extinguished due to an electrical problem. The extinguishment of the light sources is unfavorable in the case of indicating the tone range, the tone quality or the like with the hues of the light sources.

SUMMARY OF THE INVENTION

The present invention contemplates to eliminate the disadvantage of the prior art as described above, and has for its object to provide a slide rheostat in which light sources are not extinguished when their hues change over, and in which at the change-over of the hues, both the light sources emit light to indicate a desired quantity in the composite color of the hues, so that the quantity can be recognized with the hues of the light sources at all times.

In order to accomplish the object, the present invention consists in that an overlapping portion with which all light source sliders contact slidingly is formed in at least a part of each power supply lead.

More concretely, a slide rheostat according to the present invention comprises a lever which protrudes out of a case and; first and second light sources which are mounted on said lever. A common lead from a common light source slider supplies current to said first and second light sources slides and power supply leads supply the respective light sources with current from respective sliders. Each of the power supply leads is formed with a portion in, at least, a part thereof which can accommodate both slides contacting the power supply leads at the same time.

BRIEF DESCRIPTION OF THE DRAWINGS

FIGS. 1 to 5 show a slide rheostat embodying the present invention, in which FIG. 1 is an exterior side view of the slide rheostat, FIG. 2 is a top plan view of an insulating base plate, FIG. 3 is an enlarged detailed view of a light source portion, FIG. 4 is a model diagram for explaining the situation of the light emitting operations of light sources, and FIG. 5 is a diagram for explaining the positional relationship between a common lead and power supply leads on the insulating base plate in FIG. 2 and light source sliders.

PREFERRED EMBODIMENTS OF THE INVENTION

Now, embodiments of the present invention will be described with reference to the drawings.

Figure 1:
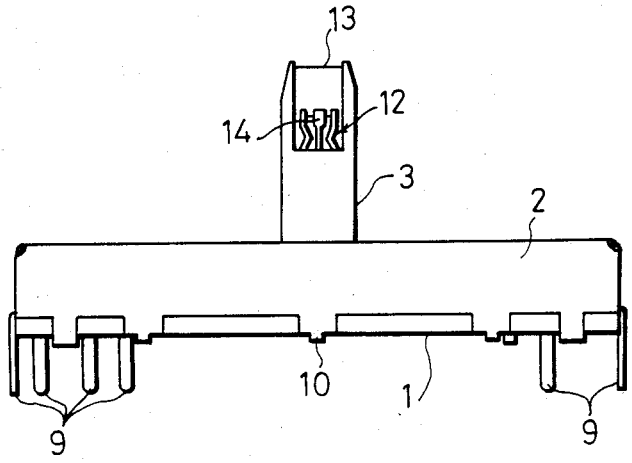
Figure 2:
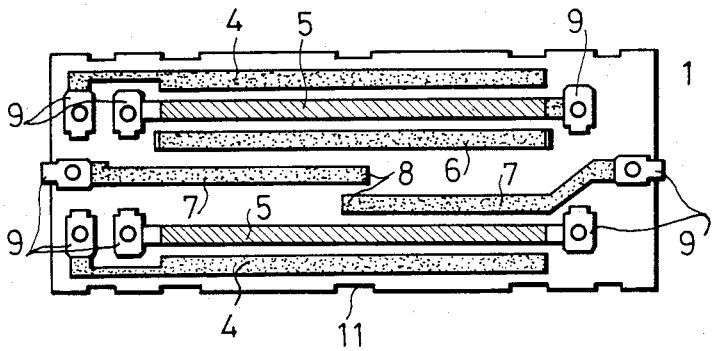
Figure 3:
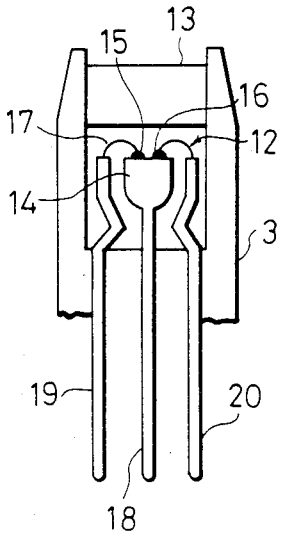

FIG. 1 is a side view of a slide rheostat according to the present invention, FIG. 2 is a top plan view of an insulating base plate, and FIG. 3 is an enlarged detailed view of a lever portion shown in FIG. 1.

As illustrated in FIG. 1, the slide rheostat is constructed of an insulating base plate 1, a metal case 2 which covers the insulating base plate 1, and a lever 3 which slides on the insulating base plate 1 in contact therewith.

As illustrated in FIG. 2, collectors 4 and resistors 5 for the variable resistor are printed on the insulating base plate 1. Sliders (not shown) attached to the lever 3 slide in contact with the collectors and resistors in accordance with the manipulation of the lever 3, so as to vary the resistance value of the variable resistor. The construction and operation thus far described are the same as in the prior-art slide rheostat.

A common lead 6 and two power supply leads 7 according to the present invention are printed inside or between the resistors 5 for the variable resistor, and the power supply leads 7 are formed with portions 8 which extend past or overlap with each other. Numeral 9 designates terminals which are disposed at the ends of the collectors 4, resistors 5, common lead 6 and power supply leads 7. Numeral 10 designates mounting lugs provided in the metal case 2, and numeral 11 notches formed in the insulating base plate 1. The metal case 2 and the insulating base plate 1 are fixed by bending the mounting lugs 10 along the notches 11.

Shown at numeral 12 is light source means which is enclosed in the lever 3 with a transparent resin 13 for guiding light. As shown in FIGS. 1 and 3, the light source means 12 consists of two light emitting diodes 15 and 16 of different emission colors and in the form of chips, the diodes being placed on an electrode 14 and being respectively bonded by jumper wires 12.

Figure 4:
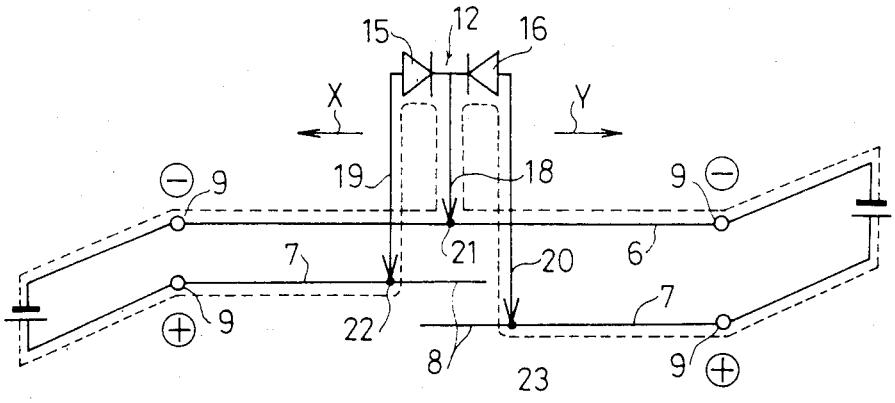
Figure 5:
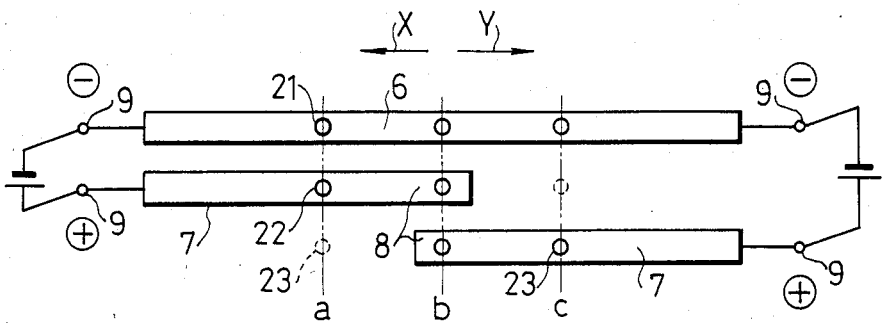

As shown in FIGS. 4 and 5, the electrode 14 and the light emitting diodes 15 and 16 are respectively connected via connecting terminals 18, 19 and 20 to light source sliders 21, 22 and 23 which slide in contact with the common lead 6 and the power supply leads 7 and 7.

With the slide rheostat of the present invention having such structure, when the hues of the light sources 12 change over, a desired quantity to be displayed at that position of the sliders is indicated in the composite color of the hues and can be recognized as such. This situation will be described with reference to FIGS. 4 and 5.

According to the present invention, the power supply leads 7 and 7 are respectively formed with the overlapping portions 8 as illustrated in FIGS. 4 and 5. Therefore, even when the hues change over, the light sources 12 are lit up in the composite color.

FIG. 4 is a model diagram for explaining the light emitting operations of the light sources 12, while FIG. 5 is a diagram for explaining the positional relationship between the common lead 6 and power supply leads 7, 7 on the insulating base plate 1 in FIG. 2 and the light source sliders 21, 22 and 23 which slide in contact with these leads.

As seen from FIG. 4, the common lead 6 is connected to the minus side of a power source, while the power supply leads 7, 7 are connected to the plus side of the power source. The light source sliders 21 and 22, 23 are held in sliding contact with the common lead 6 and power supply leads 7, 7 as shown in FIG. 4, respectively.

Arrows X and Y in FIG. 4 indicate the moving directions of the lever 3 in FIG. 1. When the lever 3 is moved in the X direction or Y direction, the light sources 12 move with the movement of the lever 3, and also the light source sliders 21 and 22, 23 move in the same direction while sliding in contact with the common lead 6 and power supply leads 7, 7.

First, on the left side with respect to the node of the light emitting diodes 15 and 16 in FIG. 4, as indicated by a broken line in the figure, current flows along the path of the ⊕ terminal 9, power supply lead 7, light source slider 22, connecting terminal 19, light emitting diode 15, connecting terminal 18, light source slider 21, common lead 6 and ⊖ terminal 9, so that the light emitting diode 15 emits light in, e.g., red.

On the other hand, on the right side with respect to the node in FIG. 4 mentioned above, current flows in a direction indicated by a broken line in the figure, so that the light emitting diode 16 emits light in, e.g., yellow.

When, in this manner, the light emitting diodes 15 and 16 emit light at the same time, apparently the composite color of red and yellow is displayed on the lever 3.

That is, since the power supply leads 7, 7 overlap at the portions 8, 8 as shown in FIG. 5, the circuits of both the light emitting diodes 15, 16 are simultaneously closed to emit light as illustrated in FIG. 4 when the hue of the light source means 12 changes from red over to yellow.

In other words, the state in which the light emitting diodes 15, 16 emit light simultaneously is a case where all the light source sliders 21, 22 and 23 lie on a line b in FIG. 5, and where the light source sliders 21 and 22, 23 are in sliding contact with the common lead 6 and power supply leads 7, 7 (particularly, overlapping portions 8) respectively.

Accordingly, when the lever 3 is located on a line a by moving it in the direction of the arrow X from on the line b in FIG. 5, the light source sliders 21 and 22 are respectively in sliding contact with the common lead 6 and power supply lead 7, and hence, only the side of the light emitting diode 15 becomes closed and emits light. The light emitting diode 16 does not emit light because the side of this diode has the light source slider 23 released from the sliding contact with the power supply lead 7 and becomes open.

In the state in which the lever 3 is moved rightwards in FIG. 5 as indicated by the arrow Y, to locate the light source sliders 21, 22 and 23 on a line c, the light emitting diode 16 emits light and the light emitting diode 15 does not, conversely to the case of the line a.

In this manner, in the embodiment of the present invention, the power supply leads 7, 7 are formed with the overlapping portions 8, 8. Therefore, even when the hues of the light source means 12 change over, the light emitting diodes 15 and 16 emit light simultaneously to effect the display in the composite color, so that the sound volume, tone quality, resistance value, or the like can be recognized from the hue of the light source means 12 at all times.

Figure 6:
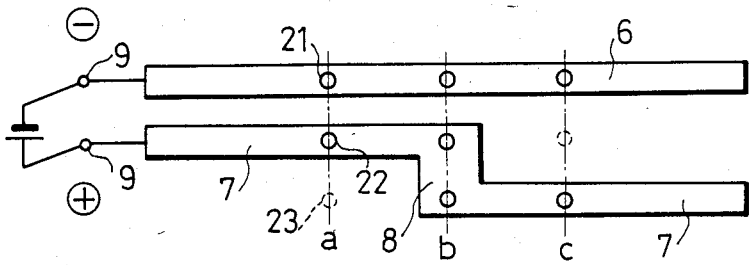
FIGS. 6 and 7 are diagrams each showing a modification of the arrangement illustrated in FIG. 5.
Figure 7:
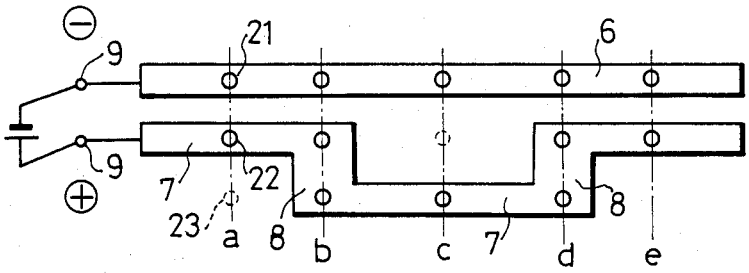

FIGS. 6 and 7 show modified embodiments of the arrangement in FIG. 5. The foregoing embodiment of FIG. 5 has been applied to the slide rheostat wherein the two rows of collectors 4 and resistors 5 are disposed on the insulating base plate 1 as shown in FIG. 2, so that the two power supply leads 7, 7 are disposed and have their fore ends formed into the overlapping portions 8, 8. The embodiment of FIG. 6 or FIG. 7 is applied to a slide rheostat which includes a single row of collector 4 and resistor 5. Herein, an elongated power supply lead 7 is divided into two portions by a bent portion 8 extending perpendicularly to the length of the power supply lead 7 so as to form portion 8 accommodating both sliders 22 and 23.

In a case where the light source sliders 21, 22 and 23 lie on lines a, b or c in FIG. 6 or 7, the light emitting diodes (or diode) 15 and (or) 16 emit light likewise to the case of FIG. 5.

In the embodiment of FIG. 7, two bent portions 8 are formed so in the case where the light source sliders lie on a line d in FIG. 7, both the light emitting diodes 15 and 16 emit light as in the case where they lie on the line b. In a case where they lie on a line e in FIG. 7, only the light emitting diode 15 emits light as in the case where they lie on the line a. The other points are the same as in the arrangement of FIG. 5, and shall be omitted.

According to the present invention, an overlapping portion or portions with which all light source sliders slide in contact is/are disposed in, at least, a part or parts of a power supply lead or leads, so that light source means is not put out when the hues of the light source means change over, and that a desired quantity can be indicated in a composite color during the shift of the hues, whereby the quantity can be recognized from the hue of the light source means at all times.

What is claimed is:

1. A slide rheostat comprising:

a lever which protrudes out of a case;

first and second light sources which are mounted on said lever;

a common lead with which a common light source slider for supplying current to said first and second light sources slides in contact;

power supply leads with which respective light source sliders for supplying the current to said first and second light sources slide in contact, and each of which is formed with an overlapping portion in, at least, a part thereof; and an insulating base plate on which resistors and collectors of said rheostat and also said common lead and said power supply leads are printed.

2. A slide rheostat according to claim 1, wherein said first and second light sources are light emitting diodes.

3. A slide rheostat according to claim 1, wherein said resistors and said collectors of said rheostat are printed in two sets.

4. A slide rheostat according to claim 1, wherein said power supply leads are interconnected through the overlapping portions.

5. A slide rheostat according to claim 1, wherein said first and second light sources have different emission colors.

6. In a variable resistor having a slide movable longitudinally along a substrate carrying a resistive portion for varying resistance between output terminals of said variable resistor and carrying two light-emitting devices each adapted to emit light during movement of said slider along respective portions of said resistive portion, a common collector connected to each of said light-emitting devices through said slider, and means including respective portions of a power supply line connected to each of said light-emitting devices through a respective contact of said slider for supplying current to one of said light-emitting devices during movement of said slider along one area of said resistive portion and supplying current to the other of said light emitting devices during movement of said slider during the other area of said resistive portion, the improvement including means for assuring both of said respective contacts are held in contact with said power supply line as said slider is moved in transition from one of said areas of said resistive portion to the other of said areas to activate both of said light-emitting devices during said transition.

7. A variable resistor according to claim 6, said assuring means including areas of said respective portions of said power supply line extending past one another in overlapping manner.

8. A variable resistor according to claim 6, said assuring means including areas of said respective portions being interconnected by a bride portion adapted to engage said contacts simultaneously during said transition.

9. A variable resistor according to claim 6, said light-emitting devices being light-emitting diodes of differing colors.

* * * * *